US011034549B2

(12) United States Patent
Hu

(10) Patent No.: US 11,034,549 B2
(45) Date of Patent: Jun. 15, 2021

(54) GAP-REDUCING SILL ASSEMBLY FOR AN ELEVATOR CAR

(71) Applicant: OTIS ELEVATOR COMPANY, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 435 days.

(21) Appl. No.: 15/962,009

(22) Filed: Apr. 25, 2018

(65) Prior Publication Data

US 2019/0330027 A1 Oct. 31, 2019

(51) Int. Cl.

| | |
|---|---|
| ***B66B 13/30*** | (2006.01) |
| ***B66B 13/24*** | (2006.01) |
| ***B66B 13/28*** | (2006.01) |

(52) U.S. Cl.

CPC ..... *B66B 13/301* (2013.01); *B66B 13/245* (2013.01); *B66B 13/28* (2013.01)

(58) Field of Classification Search

CPC ..... B66B 13/301; B66B 13/245; B66B 13/28
See application file for complete search history.

(56) References Cited

U.S. PATENT DOCUMENTS 1,738,729 A * 12/1929 Richardson ..... B66B 13/245 187/414
2,739,354 A * 3/1956 Pope ..... B66B 17/18 187/400
4,058,191 A * 11/1977 Balbo ..... B66B 13/30 187/239
9,932,171 B1 * 4/2018 Hall ..... B66B 17/18
2006/0243534 A1 * 11/2006 Miller ..... B66B 13/301 187/313
2009/0301821 A1 * 12/2009 Fujiki ..... B66B 13/26 187/400

(Continued)

FOREIGN PATENT DOCUMENTS

CN 201914816 U 8/2011
CN 202080797 U 12/2011

(Continued)

OTHER PUBLICATIONS

Mikko Nordlund, Development of Door Sill Assembly Test System, Metropolia University of Applied Sciences, Bachelor of Engineering, Mechanical Engineering and Production Technology, Bachelor's Thesis, Jun. 3, 2013, 76 pages.

(Continued)

*Primary Examiner* — Michael A Riegelman
(74) *Attorney, Agent, or Firm* — Carlson, Gaskey & Olds

(57) ABSTRACT

An illustrative example elevator sill assembly includes a sill plate and at least one support arm secured to the sill plate. A mounting bracket is configured to be mounted to an elevator car. The support arm is supported on the mounting bracket to allow the support arm to pivot relative to the mounting bracket. At least one actuator arm has a portion configured to be contacted by a door of the elevator car to cause movement of the actuator arm relative to the mounting bracket as the door moves into an open position. The movement of the actuator arm causes the support arm to pivot relative to the mounting bracket to thereby cause the sill plate to pivot from a stored position to an actuated position.

7 Claims, 6 Drawing Sheets

(56) References Cited

U.S. PATENT DOCUMENTS

| | | | | |
|---|---|---|---|---|
| 2015/0096842 | A1* | 4/2015 | Cao | B66B 17/18 187/337 |
| 2017/0137263 | A1* | 5/2017 | Yoshida | B66B 13/308 |
| 2018/0370770 | A1* | 12/2018 | Wakasa | B66B 13/308 |
| 2019/0330027 | A1* | 10/2019 | Hu | B66B 13/245 |
| 2019/0330028 | A1* | 10/2019 | Hu | B66B 13/301 |

FOREIGN PATENT DOCUMENTS

| | | | |
|---|---|---|---|
| CN | 101948070 | B | 7/2012 |
| CN | 102992151 | A | 3/2013 |
| CN | 102040143 | B | 5/2013 |
| CN | 202936074 | U | 5/2013 |
| CN | 101985340 | B | 6/2013 |
| CN | 203903744 | U | 10/2014 |
| CN | 204689328 | U | 10/2015 |
| CN | 104803268 | B | 8/2016 |
| EP | 3 192 764 | A1 | 7/2017 |
| EP | 3 418 243 | A1 | 12/2018 |
| JP | S5066365 | U | 6/1975 |
| JP | 2000118931 | A | 4/2000 |
| JP | 2009249116 | A | 10/2009 |
| JP | 2010013214 | A | 1/2010 |
| JP | 2010143730 | A | 7/2010 |
| JP | 2013180861 | A | 9/2013 |

OTHER PUBLICATIONS

Extended European Search Report for EP Application No. EP 19 17 0121 dated Sep. 27, 2019.

* cited by examiner

GAP-REDUCING SILL ASSEMBLY FOR AN ELEVATOR CAR

BACKGROUND

Elevators are in widespread use for carrying passengers and items among different levels in buildings, for example. When an elevator car is situated at a landing to allow passengers to enter or exit the car, a sill on the elevator car is aligned with a sill at the landing. Various aspects of elevator systems require some distance or spacing between the landing sill and the elevator car sill. That distance typically results in a gap that is wide enough for an object to fall through the gap and into the hoistway. For example, an individual dropping a key, coin, or credit card at the threshold to the elevator car might drop it through the gap between the sills. Additionally, some shoes include relatively thin, high heels that may at least partially slip into the gap, which is undesirable.

While various proposals have been made for reducing the gap between the elevator car sill and the landing sill or filling that gap when an elevator car is at the landing, none of them have been fully satisfactory.

SUMMARY

An illustrative example elevator sill assembly includes a sill plate and at least one support arm secured to the sill plate. A mounting bracket is configured to be mounted to an elevator car. The support arm is supported on the mounting bracket to allow the support arm to pivot relative to the mounting bracket. At least one actuator arm has a portion configured to be contacted by a door of the elevator car to cause movement of the actuator arm relative to the mounting bracket as the door moves into an open position. The movement of the actuator arm causes the support arm to pivot relative to the mounting bracket to thereby cause the sill plate to pivot from a stored position to an actuated position.

In an example embodiment having one or more features of the assembly of the previous paragraph, the at least one support arm pivots about a first pivot axis, the actuator arm is supported on the mounting bracket to allow the actuator arm to pivot relative to the mounting bracket along a second pivot axis and the first pivot axis is perpendicular to the second pivot axis.

In an example embodiment having one or more features of the assembly of any of the previous paragraphs, the at least one support arm has one end, a sill plate holder near the one end and a first plurality of gear teeth near an opposite end, the first pivot axis is centered relative to the first plurality of gear teeth, the at least one actuator arm has one end, a door contactor near the one end and a second plurality of gear teeth near an opposite end, the second pivot axis is centered relative to the second plurality of gear teeth and the second plurality of gear teeth engage the first plurality of gear teeth during the movement of the at least one actuator arm to cause the at least one support arm to pivot relative to the mounting bracket and move the sill plate into the actuated position.

In an example embodiment having one or more features of the assembly of any of the previous paragraphs, the first plurality of gear teeth matches the second plurality of gear teeth and the one end of the at least one support arm matches the one end of the at least one actuator arm.

An example embodiment having one or more features of the assembly of any of the previous paragraphs includes a biasing member near the one end of the at least one support arm, the biasing member biasing the sill plate into the stored position.

In an example embodiment having one or more features of the assembly of any of the previous paragraphs, the biasing member comprises a magnet supported on the at least one support arm, the magnet being situated to contact a portion of the mounting bracket when the sill plate is in the stored position.

In an example embodiment having one or more features of the assembly of any of the previous paragraphs, the biasing member comprises a spring having one end coupled to the at least one support arm near the one end, the spring having another end coupled to the mounting bracket.

In an example embodiment having one or more features of the assembly of any of the previous paragraphs, the at least one support arm comprises a first support arm near one end of the sill plate and a second support arm near an opposite end of the sill plate and the at least one actuator arm comprises a first actuator arm associated with the first support arm and a second actuator arm associated with the second support arm.

In an example embodiment having one or more features of the assembly of any of the previous paragraphs, the first and second support arms and the first and second actuator arms all have an identical configuration.

In an example embodiment having one or more features of the assembly of any of the previous paragraphs, the sill plate has a mass and the mass of the sill plate and gravity urges the sill plate toward the stored position.

In an example embodiment having one or more features of the assembly of any of the previous paragraphs, the at least one actuator arm pivots about a vertical pivot axis and the at least one support arm pivots about a horizontal pivot axis.

An illustrative elevator car assembly includes a cab, at least one door that is moveable to open or close an opening into the cab, a sill beneath the at least one door, a sill plate, at least one support arm secured to the sill plate, a mounting bracket mounted to the elevator car near the sill, the at least one support arm being supported on the mounting bracket to allow the at least one support arm to pivot relative to the mounting bracket and at least one actuator arm situated to be contacted by the door as the door moves into the open position to cause movement of the at least one actuator arm relative to the mounting, the movement of the at least one actuator arm causing the at least one support arm to pivot relative to the mounting bracket to thereby cause the sill plate to pivot from a stored position at least partially beneath the sill to an actuated position where the sill plate is aligned with the sill.

In an example embodiment having one or more features of the assembly of the previous paragraph, the sill plate is oriented transverse to the sill when the sill plate is in the stored position.

In an example embodiment having one or more features of the assembly of any of the previous paragraphs, the at least one support arm comprises a first support arm near one end of the sill plate and a second support arm near an opposite end of the sill plate and the at least one actuator arm comprises a first actuator arm associated with the first support arm and a second actuator arm associated with the second support arm.

In an example embodiment having one or more features of the assembly of any of the previous paragraphs, the first and second support arms are identical, the first and second actuator arms are identical, and the actuator arms are identical to the support arms.

In an example embodiment having one or more features of the assembly of any of the previous paragraphs, the at least one support arm pivots about a first pivot axis, the actuator arm is supported on the mounting bracket to allow the actuator arm to pivot relative to the mounting bracket along a second pivot axis, and the first pivot axis is perpendicular to the second pivot axis.

In an example embodiment having one or more features of the assembly of any of the previous paragraphs, the first pivot axis is horizontal and the second pivot axis is vertical.

In an example embodiment having one or more features of the assembly of any of the previous paragraphs, the at least one support arm has one end, a sill plate holder near the one end, and a first plurality of gear teeth near an opposite end, the first pivot axis is centered relative to the first plurality of gear teeth, the at least one actuator arm has one end, a door contactor near the one end, and a second plurality of gear teeth near an opposite end, the second pivot axis is centered relative to the second plurality of gear teeth, and the second plurality of gear teeth engage the first plurality of gear teeth during the movement of the at least one actuator arm to cause the at least one support arm to pivot relative to the mounting bracket and move the sill plate into the actuated position.

In an example embodiment having one or more features of the assembly of any of the previous paragraphs, the first plurality of gear teeth matches the second plurality of gear teeth and the one end of the at least one support arm matches the one end of the at least one actuator arm.

In an example embodiment having one or more features of the assembly of any of the previous paragraphs, the sill plate has a mass and the mass of the sill plate and gravity urges the sill plate toward the stored position.

The various features and advantages of at least one example embodiment will become apparent to those skilled in the art from the following detailed description. The drawings that accompany the detailed description can be briefly described as follows.

DETAILED DESCRIPTION

Embodiments of this invention are useful for reducing the gap between the sills on an elevator car and a landing. A sill plate pivots from a stored position into an actuated positon where the sill plate at least partially blocks or covers the gap. Movement of the sill plate into an actuated position is based upon movement of the elevator car doors into an open position.

Figure 1:
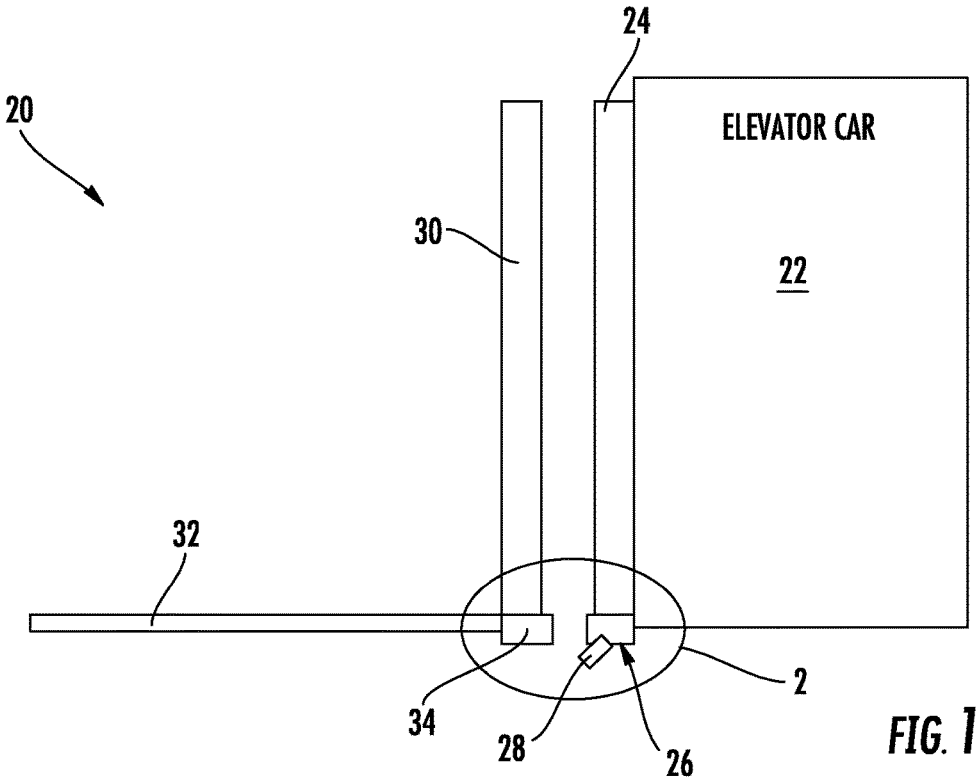
FIG. 1 schematically illustrates selected portions of an elevator system including a sill assembly designed according to an embodiment of this invention with a sill plate in a stored position.

FIG. 1 schematically illustrates selected portions of an elevator system 20. An elevator car 22 includes at least one elevator car door 24 and a sill assembly 26 positioned beneath the elevator car door 24. The sill assembly 26 includes a sill plate 28 shown in a stored position in FIG. 1. At least one landing door 30 at a landing 32 moves relative to a landing sill 34 beneath the landing door 30. The elevator car door 24 and landing door 30 move together using known coupling techniques.

Figure 2:
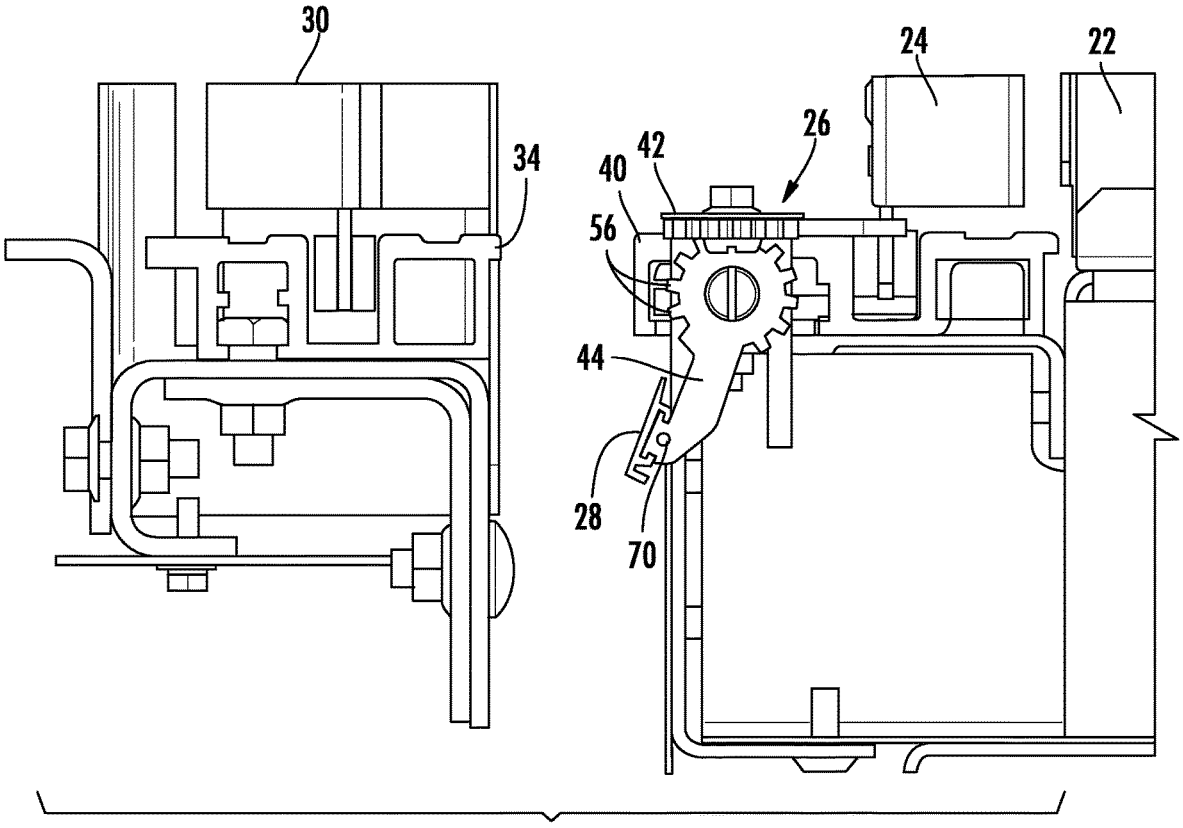
FIG. 2 diagrammatically illustrates the portion of FIG. 1 encircled at 2.

FIG. 2 provides more detail regarding the components of the sill assembly 26 in the condition shown in FIG. 1, which corresponds to the elevator car door 24 being in a closed position.

Figure 3:
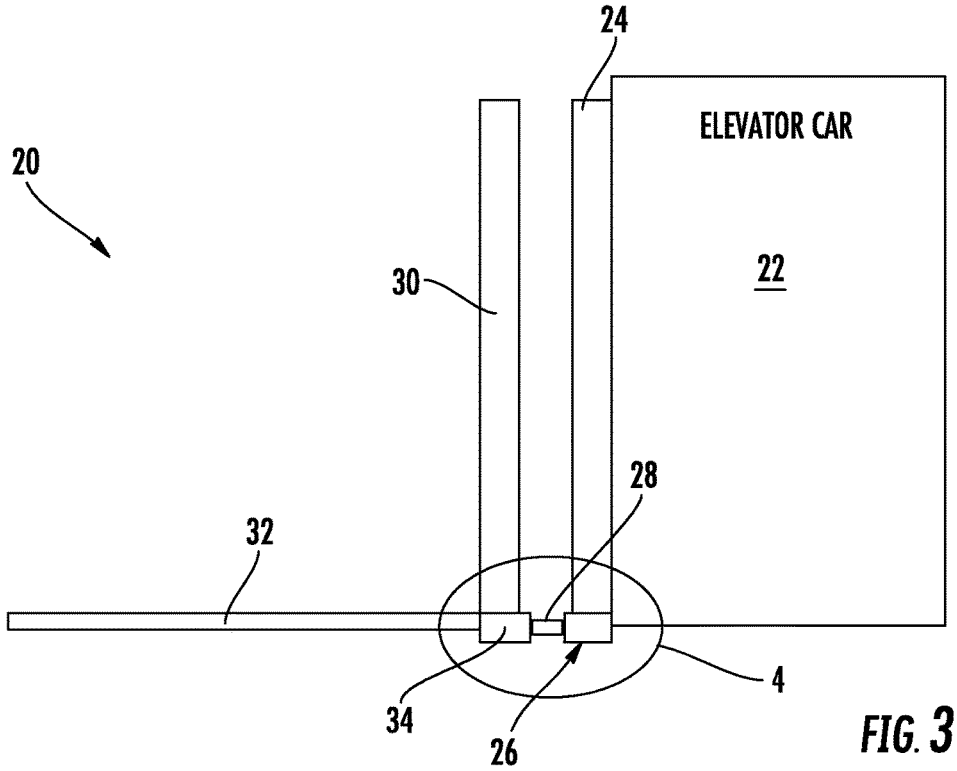
FIG. 3 schematically illustrates the portions of the elevator system shown in FIG. 1 with the sill plate in an actuated position.
Figure 4:
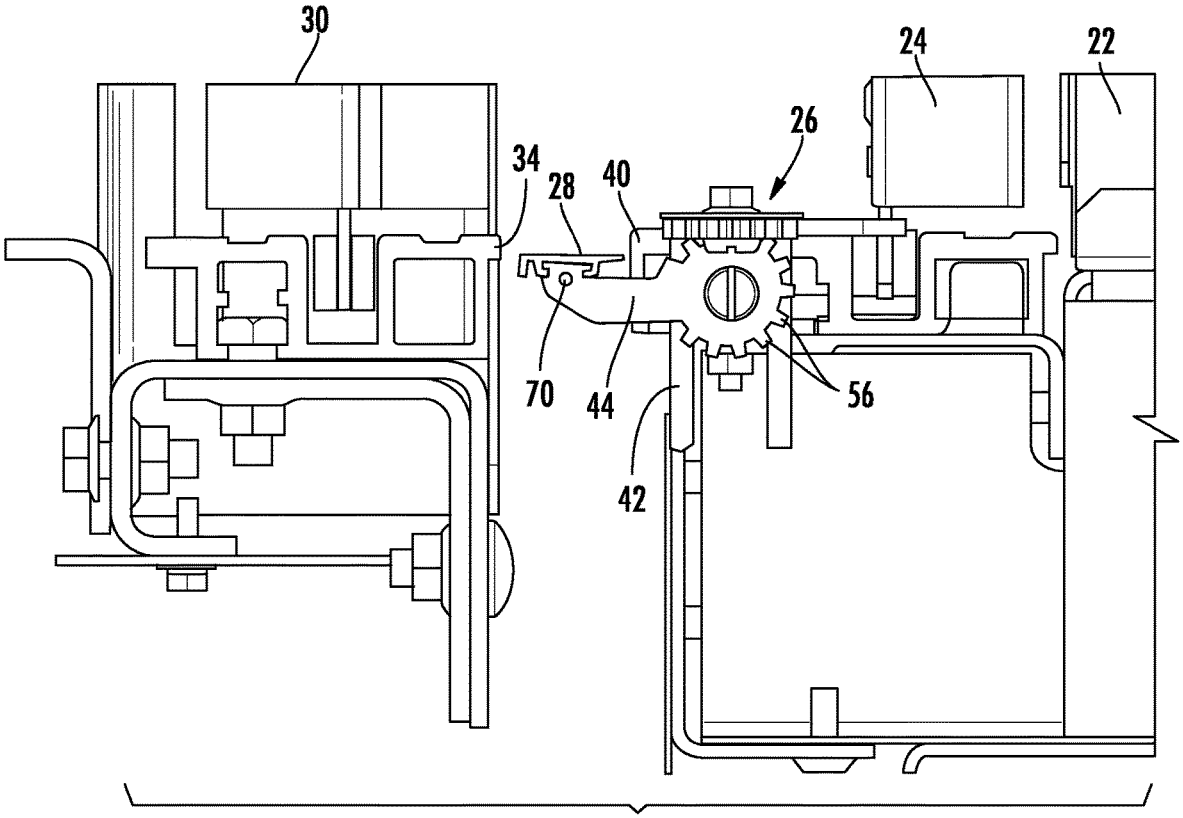
FIG. 4 diagrammatically illustrates the portion of FIG. 3 encircled at 4.

FIGS. 3 and 4 show the components illustrated in FIGS. 1 and 2 with the sill plates 28 in an actuated position where the sill plate 28 is aligned with a sill 40 of the elevator car 22 and the landing sill 34. As can be appreciated from FIG. 4 for example, in this embodiment, when the sill plate 28 is aligned with the elevator car sill 40, the upward facing surfaces of the sill plate 28 and the elevator car sill 40 are essentially parallel with each other but they are not necessarily at the same exact vertical position. In this embodiment, the sill plate 28 remains slightly beneath or recessed relative to the highest surface on the elevator car sill 40.

Figure 5:
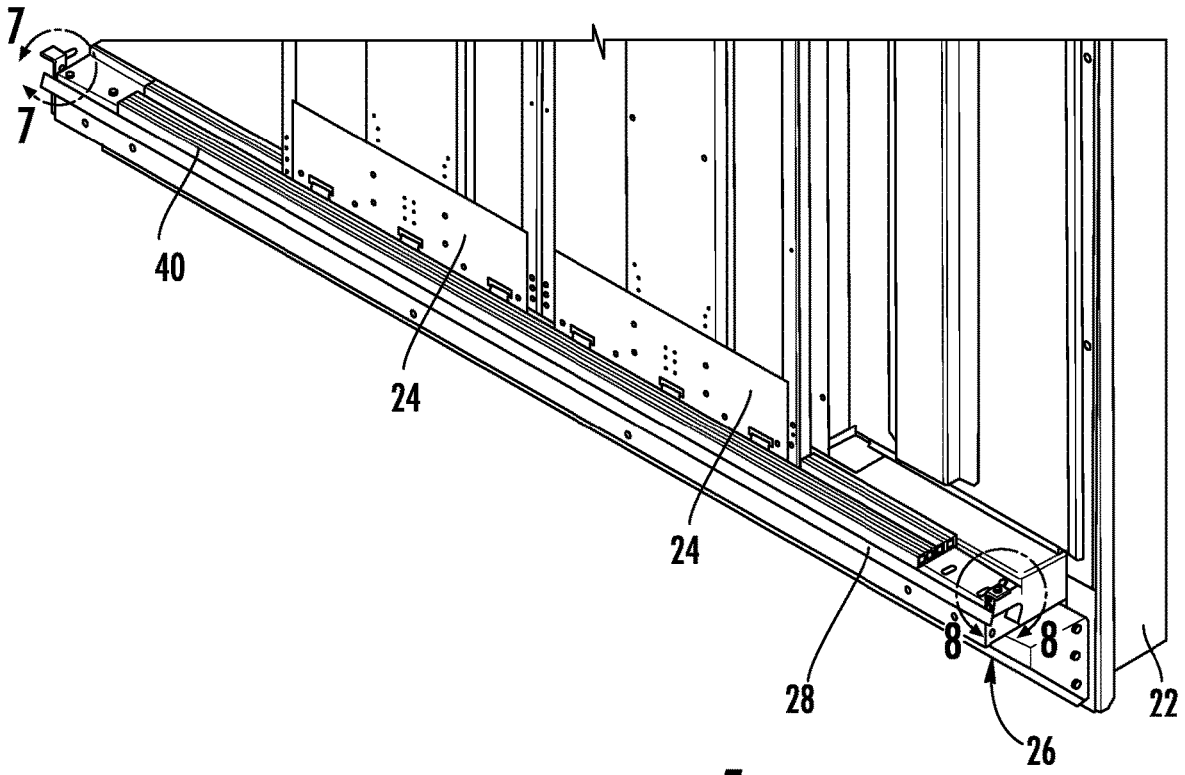
FIG. 5 diagrammatically illustrates selected features of an elevator car including a sill assembly designed according to an embodiment of this invention.
Figure 6:
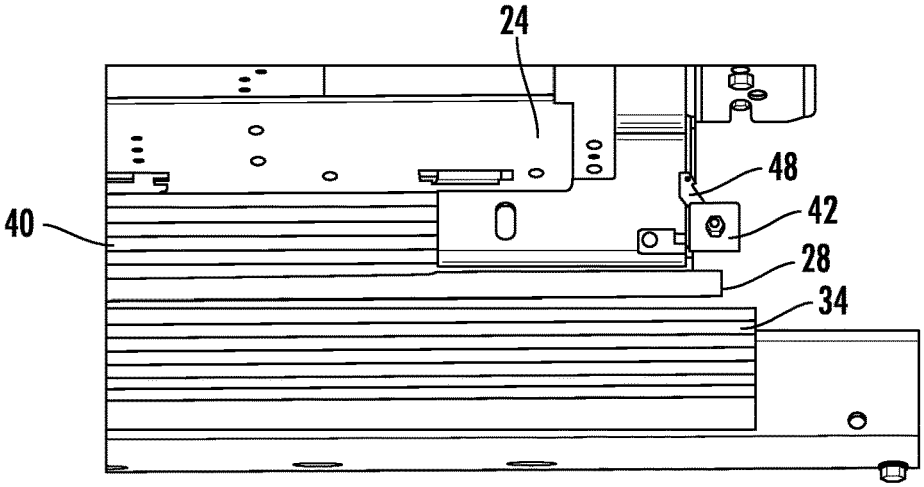
FIG. 6 is an elevational view corresponding to the condition of the component shown in FIG. 5 including the sill plate in a stored position.

FIGS. 5 and 6 show the elevator car doors 24 in a closed position. Under these conditions, the sill plate 28 is in the stored position where the sill plate 28 is transverse to the elevator car sill 40.

Figure 7:
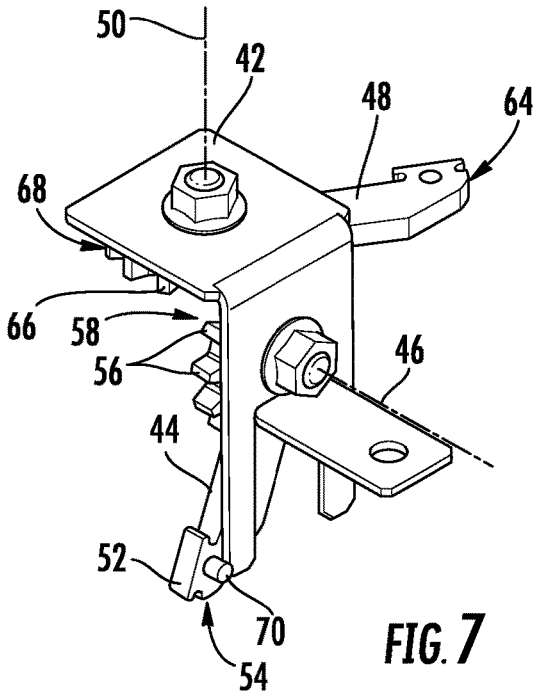
FIG. 7 diagrammatically illustrates the components encircled at 7 in FIG. 5.

As shown in FIG. 7, the sill assembly 26 includes a mounting bracket 42 that is configured to be connected with the elevator car 22. At last one support arm 44 is supported by the mounting bracket 42 so that the support arm 44 can pivot relative to the mounting bracket 42 about a pivot axis 46. In the illustrated example, the pivot axis 46 is horizontal and parallel with the elevator car sill 40. The sill plate 28 pivots about the pivot axis 46 to move between the stored and actuated positions.

At least one actuator arm 48 is supported by the mounting bracket 42 so that the actuator arm 48 can pivot about a pivot axis 50. In the illustrated example, the pivot axis 50 is vertical. The pivot axes 46 and 50 are perpendicular to each other.

Figure 8:
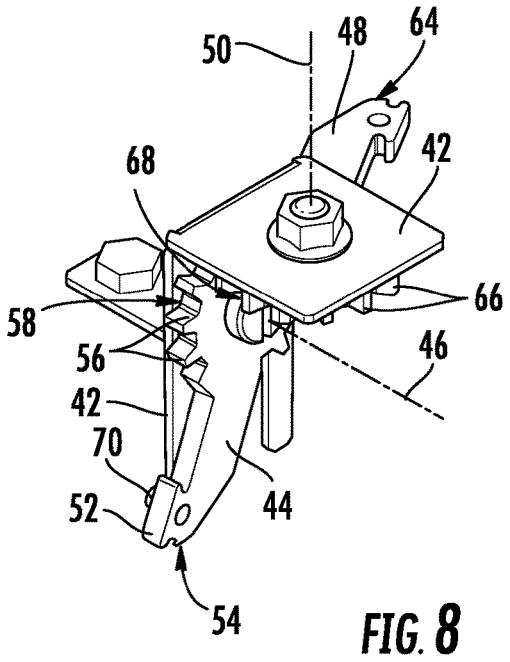
FIG. 8 diagrammatically illustrates the components encircled at 8 in FIG. 5.

As can be appreciated from FIGS. 5, 7 and 8, the illustrated example sill assembly 26 includes a mounting bracket 42, support arm 44 and actuator arm 48 near each end of the sill plate 28. The support arms 44 each include a sill plate connector 52 near one end 54 of the support arm 44. In this example, the sill plate connector 52 is configured to be at least partially received within a correspondingly shaped groove or slot on the sill plate 28 as can be appreciated, for example, from FIGS. 2 and 4.

The support arms 44 include a plurality of teeth 56 near an opposite end 58 of the support arms 44. In this example, the pivot axis 46 is centered relative to the gear teeth 56.

The actuator arms 48 include one end 64 that is configured to be contacted by a portion of the elevator car doors 24 as the car doors move toward an open position. The actuator arms 48 include gear teeth 66 near an opposite end 68 that are situated to engage or mesh with the gear teeth 56 on the support arms 44.

Figure 9:
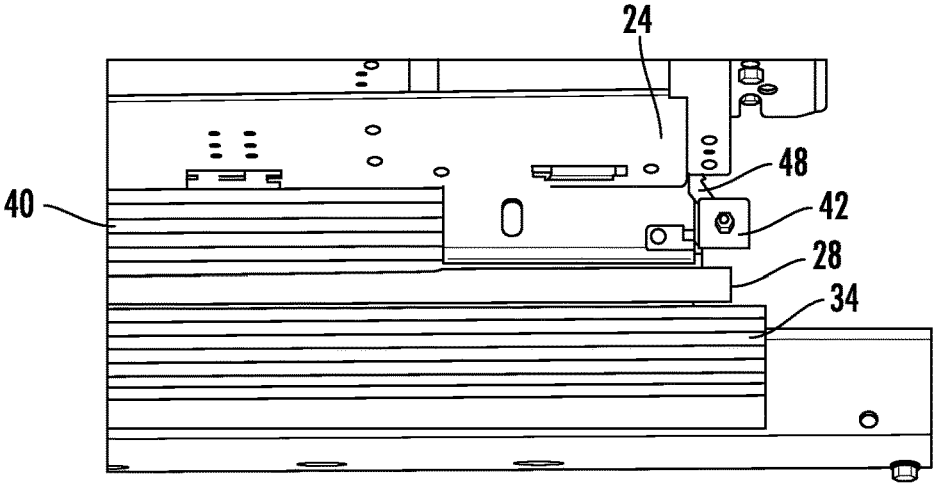
FIG. 9 is an elevational view showing the components illustrated in FIG. 6 in a condition in which an elevator door is moving toward an open position and the sill plate is moving from the stored position shown in FIG. 6 toward an actuated position.

As the elevator car doors 24 move from the closed position shown in FIG. 5 toward an open position, a portion of each door 24 contacts a corresponding one of the actuator arms 48 causing the actuator arm to pivot relative to the mounting bracket 42. Such contact is shown in FIG. 9, for example. As the actuator arms 48 pivot relative to the mounting bracket 42, the gear teeth 66 cause movement of the gear teeth 56 resulting in pivotal movement of the support arms 44. Such pivotal movement of the support arms 44 results in the sill plate 28 pivoting from the stored position toward the actuated position.

Figure 11:
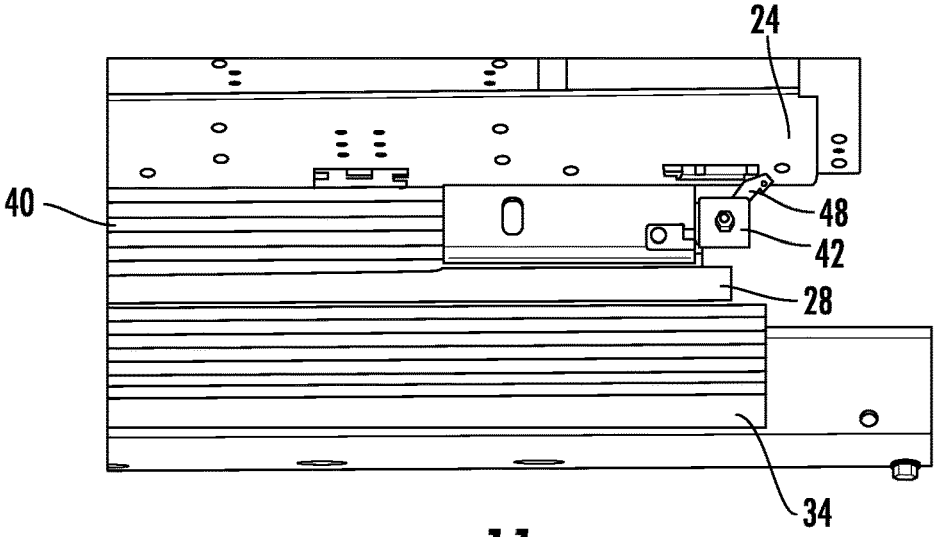
FIG. 11 is an elevational view corresponding to the condition shown in FIG. 10.
Figure 10:
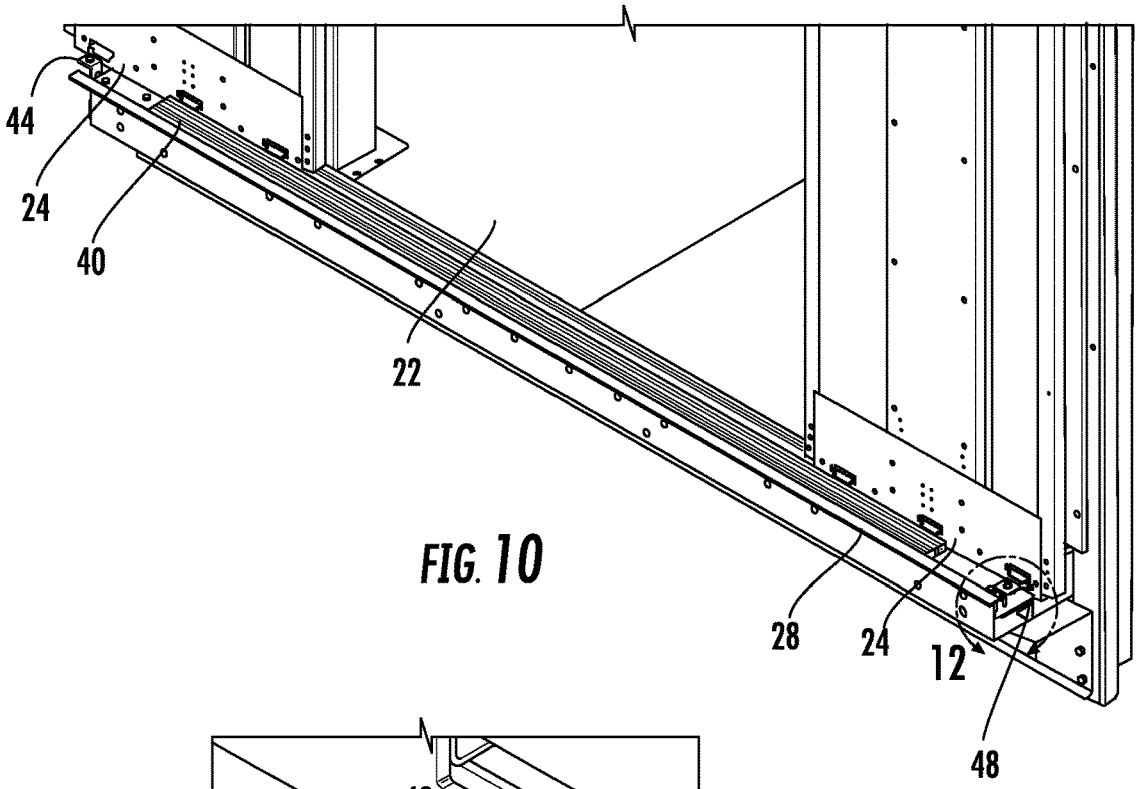
FIG. 10 diagrammatically illustrates selected portions of an elevator car with the doors opened and the sill plate in an actuated position.
Figure 12:
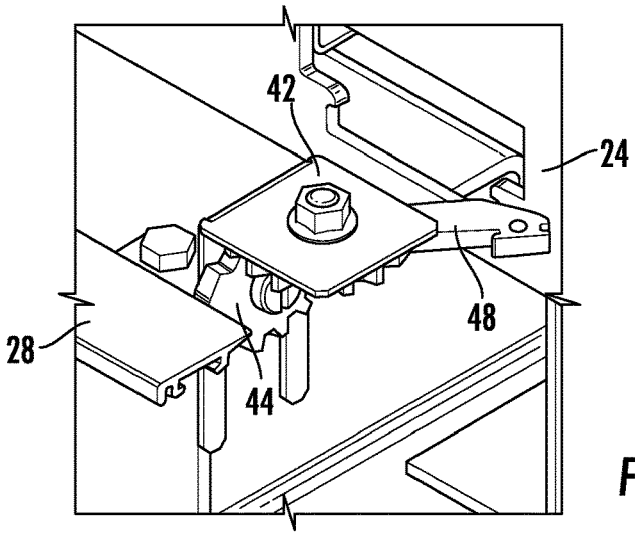
FIG. 12 diagrammatically illustrates the portions of FIG. 10 encircled at 12.

As shown in FIGS. 10-12, when the car doors 24 reach a fully opened position, the actuator arms 48 have pivoted sufficiently to cause pivotal movement of the support arms 44 to bring the sill plate 28 fully into the actuated position where the sill plate 28 is aligned with the elevator car sill 40. The sill plate 28 is held in the actuated position by the presence of the car doors 24 preventing movement of the actuator arms 48, which prevents movement of the support arms 44. Once the elevator car doors 24 move back toward the closed position far enough to be spaced away from the actuator arms 48, the mass of the sill plate 28 and gravity pull the sill plate 28 back into the stored position.

As can be appreciated from FIGS. 7, 8 and 2, the sill assembly 26 includes a biasing member 70 that biases the sill plate 28 into the stored position. In this example embodiment, the biasing member 70 comprises a magnet that is secured to the support arm 44. The magnet is magnetically attracted to the metal of the mounting bracket 42 and tends to bias or hold the sill plate 28 in the stored position during elevator car movement.

Figure 13:
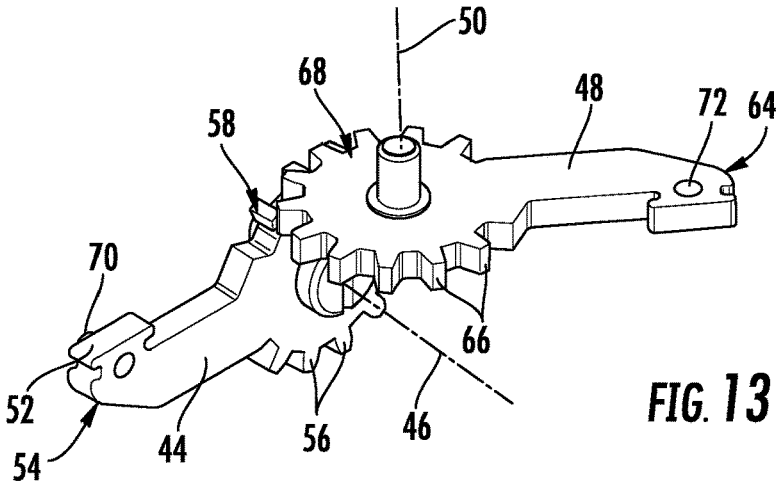
FIG. 13 diagrammatically illustrates selected components from FIG. 12.

FIG. 13 shows a support arm 44 and actuator arm 48 in the positions also shown in FIG. 12. As can be appreciated from FIG. 13, the configuration or structure of the support arm 44 and the actuator arm 48 are identical in the illustrated example embodiment. When used as a support arm, the one end 54 serves as a connector for connecting the support arm 44 with the sill plate 28. When used as an actuator arm 48, the one end 64 serves as a contact portion for making contact with an elevator car door for purposes of moving the sill plate 28 between the stored and actuated positions. The ends 54 and 64 each include an opening or receiver 72 for receiving a magnet 70 depending on whether the particular arm is being used as a support arm. The geared teeth 56 and 66 on the respective ends 58 and 68 are also identical in this embodiment. The configuration of the example support arms 44 and actuator arms 48 also allow for the same component to be used on either end of the sill plate 28 by simply reversing the orientation of the actuator arm 48. Other embodiments include support arms 44 and actuator arms 48 that are configured differently than the illustrated examples and in some embodiments the support arms 44 and actuator arms 48 are not identical.

In an example embodiment, the arms 44 and 48 comprises a plastic material, such as an ultrahigh molecular weight polyethylene. Such materials are cost efficient, reduce or avoid friction and do not tend to introduce noise during movement of the sill plate 28.

Figure 14:
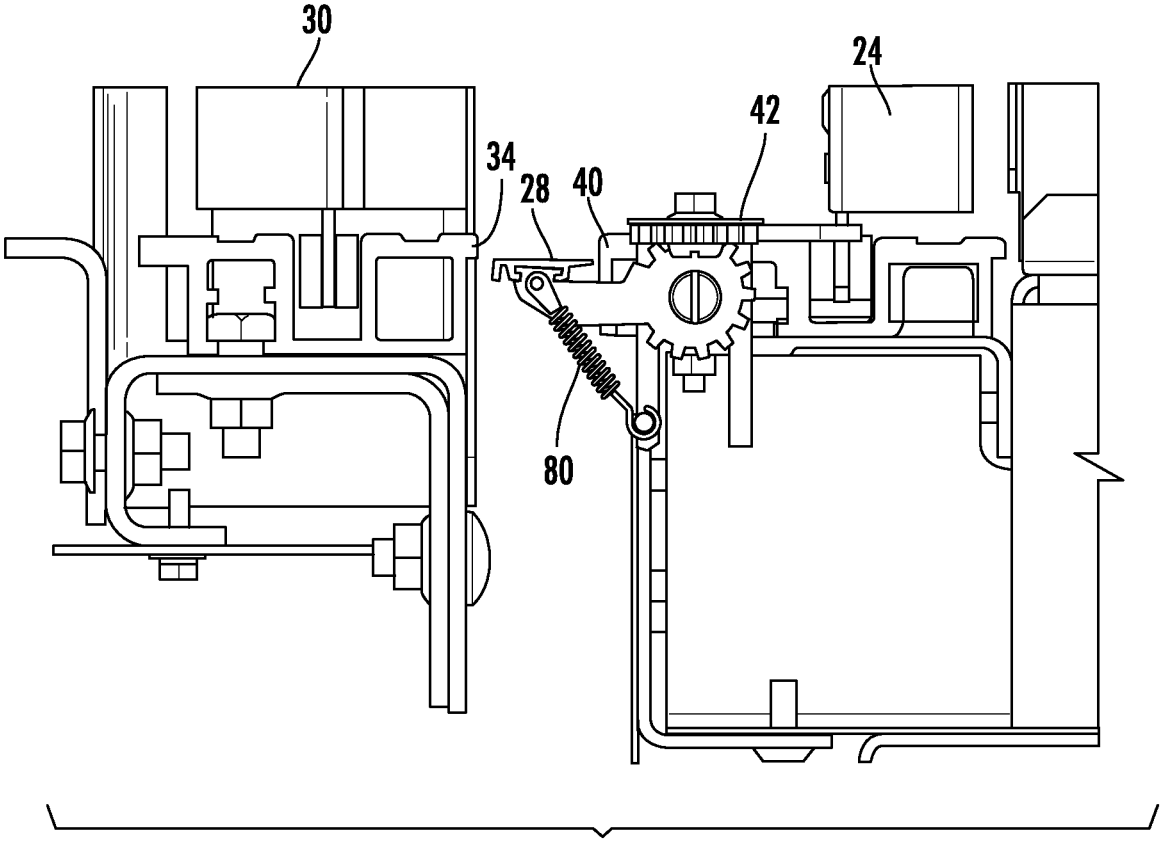
FIG. 14 diagrammatically illustrates another example embodiment with the sill plate in the actuated position.

FIG. 14 illustrates another example embodiment in which a biasing member 80 that comprises a spring urges the sill plate 28 into the stored position. When in the actuated position as shown in FIG. 14, the spring biasing member 80 in this example is extended. The spring biasing member 80 tends to retract for holding the sill plate 28 in the stored position during elevator car movement.

Embodiments of this invention improve the aesthetics of an elevator system by reducing a visible gap between the elevator car sill 40 and the landing sill 34. In the actuated position, the sill plate 28 reduces the possibility of elevator passengers inadvertently dropping small items into the hoistway. The illustrated example embodiments can be used in elevator systems that include advance door opening techniques without interfering with the efficiencies provided by such techniques. The design of the components of the illustrated examples reduces the number of parts that have to be maintained in inventory and facilitates easier assembly.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator car assembly, comprising:

a cab;

at least one door that is moveable to open or close an opening into the cab;

a sill beneath the at least one door;

a sill plate;

at least one support arm secured to the sill plate;

a mounting bracket mounted to the elevator car near the sill, the at least one support arm being supported on the mounting bracket to allow the at least one support arm to pivot relative to the mounting bracket; and at least one actuator arm situated to be contacted by the door as the door moves into the open position to cause movement of the at least one actuator arm relative to the mounting, the movement of the at least one actuator arm causing the at least one support arm to pivot relative to the mounting bracket to thereby cause the sill plate to pivot from a stored position at least partially beneath the sill to an actuated position where the sill plate is aligned with the sill;

wherein:

the at least one support arm pivots about a first pivot axis;

the actuator arm is supported on the mounting bracket to allow the actuator arm to pivot relative to the mounting bracket along a second pivot axis;

the first pivot axis is perpendicular to the second pivot axis;

the first pivot axis is horizontal; and the second pivot axis is vertical.

2. The assembly of claim 1, wherein the sill plate is oriented transverse to the sill when the sill plate is in the stored position.

3. The assembly of claim 1, wherein the at least one support arm comprises a first support arm near one end of the sill plate and a second support arm near an opposite end of the sill plate; and the at least one actuator arm comprises a first actuator arm associated with the first support arm and a second actuator arm associated with the second support arm.

4. The assembly of claim 3, wherein the first and second support arms are identical;

the first and second actuator arms are identical; and the actuator arms are identical to the support arms.

5. The assembly of claim 1, wherein the at least one support arm has one end, a sill plate holder near the one end, and a first plurality of gear teeth near an opposite end;

the first pivot axis is centered relative to the first plurality of gear teeth;

the at least one actuator arm has one end, a door contactor near the one end, and a second plurality of gear teeth near an opposite end;

the second pivot axis is centered relative to the second plurality of gear teeth; and the second plurality of gear teeth engage the first plurality of gear teeth during the movement of the at least one actuator arm to cause the at least one support arm to pivot relative to the mounting bracket and move the sill plate into the actuated position.

6. The assembly of claim 5, wherein the first plurality of gear teeth matches the second plurality of gear teeth; and the one end of the at least one support arm matches the one end of the at least one actuator arm.

7. The assembly of claim 1, wherein the sill plate has a mass; and the mass of the sill plate and gravity urges the sill plate toward the stored position.

* * * * *